US008829983B1

(12) United States Patent
Potluri

(10) Patent No.: US 8,829,983 B1
(45) Date of Patent: Sep. 9, 2014

(54) BIAS VOLTAGE CONTROL FOR AN OUTPUT DRIVER

(71) Applicant: Xilinx, Inc., San Jose, CA (US)

(72) Inventor: Krishna Chaitanya Potluri, Hyderbad (IN)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 13/682,480

(22) Filed: Nov. 20, 2012

(51) Int. Cl.
*G05F 1/10* (2006.01)

(52) U.S. Cl.
USPC ..... 327/543; 327/112; 327/541; 327/534; 327/427

(58) Field of Classification Search
USPC ..... 327/541
See application file for complete search history.

(56) References Cited

U.S. PATENT DOCUMENTS

| | | | | |
|---|---|---|---|---|
| 6,417,653 | B1 * | 7/2002 | Massie et al. | 323/282 |
| 6,992,525 | B2 * | 1/2006 | Karlsson | 327/562 |
| 2010/0264974 | A1 * | 10/2010 | Rien et al. | 327/313 |
| 2011/0298290 | A1 * | 12/2011 | Ban et al. | 307/80 |

* cited by examiner

*Primary Examiner* — Lincoln Donovan
*Assistant Examiner* — Patrick Chen
(74) *Attorney, Agent, or Firm* — W. Eric Webostad

(57) ABSTRACT

An embodiment of an apparatus is disclosed. For this embodiment, an output driver and a bias voltage controller are included. The bias voltage controller is coupled to provide first and second bias voltages to the output driver. The bias voltage controller comprises a bias generator coupled to a first voltage supply, a second voltage supply, and a ground node. The bias generator has a first bias node for sourcing the first bias voltage. The first voltage supply is configured to provide a higher voltage level than the second voltage supply. A resistor-divider network is coupled to the first voltage supply and the ground node. A watch dog circuit is coupled to the resistor-divider network, bias generator, and the ground node. A comparison circuit is coupled to the bias generator and the second voltage supply. The comparison circuit has a second bias node for sourcing the second bias voltage.

16 Claims, 4 Drawing Sheets

BIAS VOLTAGE CONTROL FOR AN OUTPUT DRIVER

FIELD OF THE INVENTION

An embodiment relates to integrated circuit devices ("ICs"). More particularly, an embodiment relates to bias voltage control for an output driver of an IC.

BACKGROUND

For powering up an IC, conventionally such powering up is performed incrementally to avoid overstressing transistors. This incremental powering up may be performed by sequential voltage regulators; however, this adds cost.

Conventionally, powering down a device has not been incrementally controlled. Generally when a power supply is shut off, it does not instantaneously go down to zero volts. Rather, it gradually decreases to zero volts, and so conventionally powering down a device has not been incrementally controlled.

However, external and coupled to an output driver of an IC may be a capacitive load, such as may be provided by an external decoupling capacitor, a printed circuit board capacitance, and/or another external capacitance. Thus, depending on capacitive load, one device with a high capacitive load may discharge more slowly than another, even identical, device with a low capacitive load. Furthermore, a device with a large circuit load may drain or discharge more rapidly than a device with a small circuit load. Accordingly, depending on differences in capacitive load and/or circuit load among devices, such devices may discharge or charge at different rates. These differences may lead to one or more overstress conditions of on one or more transistors.

Accordingly, it would be desirable and useful to avoid an overstress condition of a transistor without having to use costly incremental voltage regulators.

SUMMARY

One or more embodiments generally relate to bias voltage control for power up and/or power down of an IC.

An embodiment relates generally to an apparatus. Such an embodiment includes an output driver and a bias voltage controller. The bias voltage controller is coupled to provide a first bias voltage and a second bias voltage to the output driver. The bias voltage controller comprises a bias generator coupled to a first voltage supply, a second voltage supply, and a ground node. The bias generator has a first bias node for sourcing the first bias voltage. The first voltage supply is configured to provide a higher voltage level than the second voltage supply. A resistor-divider network is coupled to the first voltage supply and the ground node. A watch dog circuit is coupled to the resistor-divider network, bias generator, and the ground node. A comparison circuit is coupled to the bias generator and the second voltage supply. The comparison circuit has a second bias node for sourcing the second bias voltage.

An embodiment relates generally to a method that comprises providing an output driver where the output driver comprises: a first PMOS transistor having a first gate, a first source node, and a first drain node; a second PMOS transistor having a second gate, a second source node, and a second drain node; a first NMOS transistor having a third gate, a third source node, and a third drain node; and a second NMOS transistor having a fourth gate, a fourth source node, and a fourth drain node. A first signal is provided to the first gate. A first bias voltage is provided to the second gate. A second bias voltage is provided to the third gate. A second signal is provided to the fourth gate. The first bias voltage is controlled to a first voltage level. The first voltage level is a level of a first supply voltage minus a predetermined voltage sufficient to prevent an overstress condition. The second bias voltage is controlled to be a second voltage level. The second voltage level is a higher one of a second supply voltage and the first bias voltage. A third signal is output from an output node of the output driver responsive to the first signal and the second signal.

BRIEF DESCRIPTION OF THE DRAWINGS

Accompanying drawings show exemplary embodiments. However, the accompanying drawings should not be taken to limit the embodiments shown, but are for explanation and understanding only.

DETAILED DESCRIPTION

Figure 1:
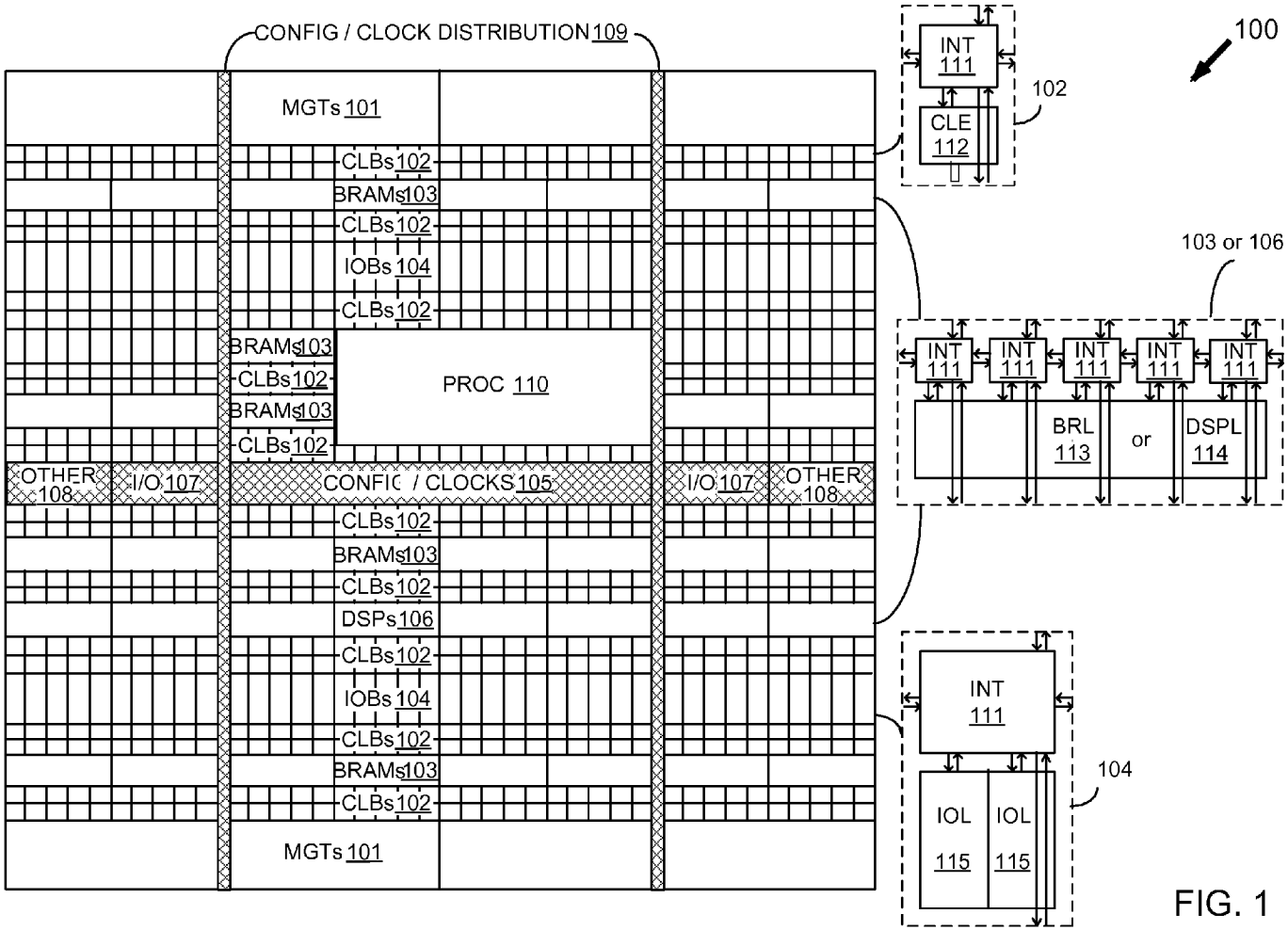
FIG. 1 is a simplified block diagram depicting an exemplary embodiment of a columnar Field Programmable Gate Array ("FPGA") architecture.

In the following description, numerous specific details are set forth to provide a more thorough description of the specific embodiments. It should be apparent, however, to one skilled in the art, that one or more embodiments may be practiced without all the specific details given below. In other instances, well known features have not been described in detail so as not to obscure the one or more embodiments. For ease of illustration, the same number labels are used in different diagrams to refer to the same items; however, in alternative embodiments the items may be different.

Before describing exemplary embodiments illustratively depicted in the several figures, a general introduction is provided to further understanding.

During power up, without proper voltage level biasing, it is possible to create an overstress condition on a transistor. Such overstress condition may lead to a failure, including without limitation a reduction in useful lifetime of such transistor.

With the above general understanding borne in mind, various embodiments for bias voltage control are generally described below. To avoid having to use costly incremental voltage regulation for power up, a bias voltage controller, embodiments of which are described below, is coupled to an output driver. Such bias voltage controller is less expensive than an incremental voltage regulator. Furthermore, such bias voltage controller not only protects from overstressing transistors during power up, but may further protect transistors during power down, as well as during normal operation.

Generally, a low voltage supply and a high voltage supply are used to provide bias voltages. These supply voltages may have different decoupling capacitances attached to them to maintain power integrity. The ramp up and ramp down rates of these voltage supplies may vary with the value of decoupling capacitances attached to the respective power supplies. As a result of this difference in ramp up/down times, an interval of time may be created where a high voltage power supply is on and a low voltage power supply is off, and so one or more bias voltages may reach unsafe values. A bias voltage controller is provided which provides safe voltages derived from a high voltage power supply during such transitory periods of operation, as well as provides a strong and accurate bias voltage generated from a low voltage power supply during normal operation. Such safe voltages are provided even though capacitive and circuit loading on power supplies may vary from application-to-application.

Because one or more of the above-described embodiments are exemplified using a particular type of IC, a detailed description of such an IC is provided below. However, it should be understood that other types of ICs may benefit from one or more of the embodiments described herein.

Programmable logic devices ("PLDs") are a well-known type of integrated circuit that can be programmed to perform specified logic functions. One type of PLD, the field programmable gate array ("FPGA"), typically includes an array of programmable tiles. These programmable tiles can include, for example, input/output blocks ("IOBs"), configurable logic blocks ("CLBs"), dedicated random access memory blocks ("BRAMs"), multipliers, digital signal processing blocks ("DSPs"), processors, clock managers, delay lock loops ("DLLs"), and so forth. As used herein, "include" and "including" mean including without limitation.

Each programmable tile typically includes both programmable interconnect and programmable logic. The programmable interconnect typically includes a large number of interconnect lines of varying lengths interconnected by programmable interconnect points ("PIPs"). The programmable logic implements the logic of a user design using programmable elements that can include, for example, function generators, registers, arithmetic logic, and so forth.

The programmable interconnect and programmable logic are typically programmed by loading a stream of configuration data into internal configuration memory cells that define how the programmable elements are configured. The configuration data can be read from memory (e.g., from an external PROM) or written into the FPGA by an external device. The collective states of the individual memory cells then determine the function of the FPGA.

Another type of PLD is the Complex Programmable Logic Device, or CPLD. A CPLD includes two or more "function blocks" connected together and to input/output ("I/O") resources by an interconnect switch matrix. Each function block of the CPLD includes a two-level AND/OR structure similar to those used in Programmable Logic Arrays ("PLAs") and Programmable Array Logic ("PAL") devices. In CPLDs, configuration data is typically stored on-chip in non-volatile memory. In some CPLDs, configuration data is stored on-chip in non-volatile memory, then downloaded to volatile memory as part of an initial configuration (programming) sequence.

For all of these programmable logic devices ("PLDs"), the functionality of the device is controlled by data bits provided to the device for that purpose. The data bits can be stored in volatile memory (e.g., static memory cells, as in FPGAs and some sCPLDs), in non-volatile memory (e.g., FLASH memory, as in some CPLDs), or in any other type of memory cell.

Other PLDs are programmed by applying a processing layer, such as a metal layer, that programmably interconnects the various elements on the device. These PLDs are known as mask programmable devices. PLDs can also be implemented in other ways, e.g., using fuse or antifuse technology. The terms "PLD" and "programmable logic device" include but are not limited to these exemplary devices, as well as encompassing devices that are only partially programmable. For example, one type of PLD includes a combination of hard-coded transistor logic and a programmable switch fabric that programmably interconnects the hard-coded transistor logic.

As noted above, advanced FPGAs can include several different types of programmable logic blocks in the array. For example, FIG. 1 illustrates an FPGA architecture 100 that includes a large number of different programmable tiles including multi-gigabit transceivers ("MGTs") 101, configurable logic blocks ("CLBs") 102, random access memory blocks ("BRAMs") 103, input/output blocks ("IOBs") 104, configuration and clocking logic ("CONFIG/CLOCKS") 105, digital signal processing blocks ("DSPs") 106, specialized input/output blocks ("I/O") 107 (e.g., configuration ports and clock ports), and other programmable logic 108 such as digital clock managers, analog-to-digital converters, system monitoring logic, and so forth. Some FPGAs also include dedicated processor blocks ("PROC") 110.

In some FPGAs, each programmable tile includes a programmable interconnect element ("INT") 111 having standardized connections to and from a corresponding interconnect element in each adjacent tile. Therefore, the programmable interconnect elements taken together implement the programmable interconnect structure for the illustrated FPGA. The programmable interconnect element 111 also includes the connections to and from the programmable logic element within the same tile, as shown by the examples included at the top of FIG. 1.

For example, a CLB 102 can include a configurable logic element ("CLE") 112 that can be programmed to implement user logic plus a single programmable interconnect element ("INT") 111. A BRAM 103 can include a BRAM logic element ("BRL") 113 in addition to one or more programmable interconnect elements. Typically, the number of interconnect elements included in a tile depends on the height of the tile. In the pictured embodiment, a BRAM tile has the same height as five CLBs, but other numbers (e.g., four) can also be used. A DSP tile 106 can include a DSP logic element ("DSPL") 114 in addition to an appropriate number of programmable interconnect elements. An IOB 104 can include, for example, two instances of an input/output logic element ("IOL") 115 in addition to one instance of the programmable interconnect element 111. As will be clear to those of skill in the art, the actual I/O pads connected, for example, to the I/O logic element 115 typically are not confined to the area of the input/output logic element 115.

In the pictured embodiment, a horizontal area near the center of the die (shown in FIG. 1) is used for configuration, clock, and other control logic. Vertical columns 109 extending from this horizontal area or column are used to distribute the clocks and configuration signals across the breadth of the FPGA.

Some FPGAs utilizing the architecture illustrated in FIG. 1 include additional logic blocks that disrupt the regular columnar structure making up a large part of the FPGA. The additional logic blocks can be programmable blocks and/or dedicated logic. For example, processor block 110 spans several columns of CLBs and BRAMs.

Note that FIG. 1 is intended to illustrate only an exemplary FPGA architecture. For example, the numbers of logic blocks in a row, the relative width of the rows, the number and order of rows, the types of logic blocks included in the rows, the relative sizes of the logic blocks, and the interconnect/logic implementations included at the top of FIG. 1 are purely exemplary. For example, in an actual FPGA more than one adjacent row of CLBs is typically included wherever the CLBs appear, to facilitate the efficient implementation of user logic, but the number of adjacent CLB rows varies with the overall size of the FPGA.

Figure 2:
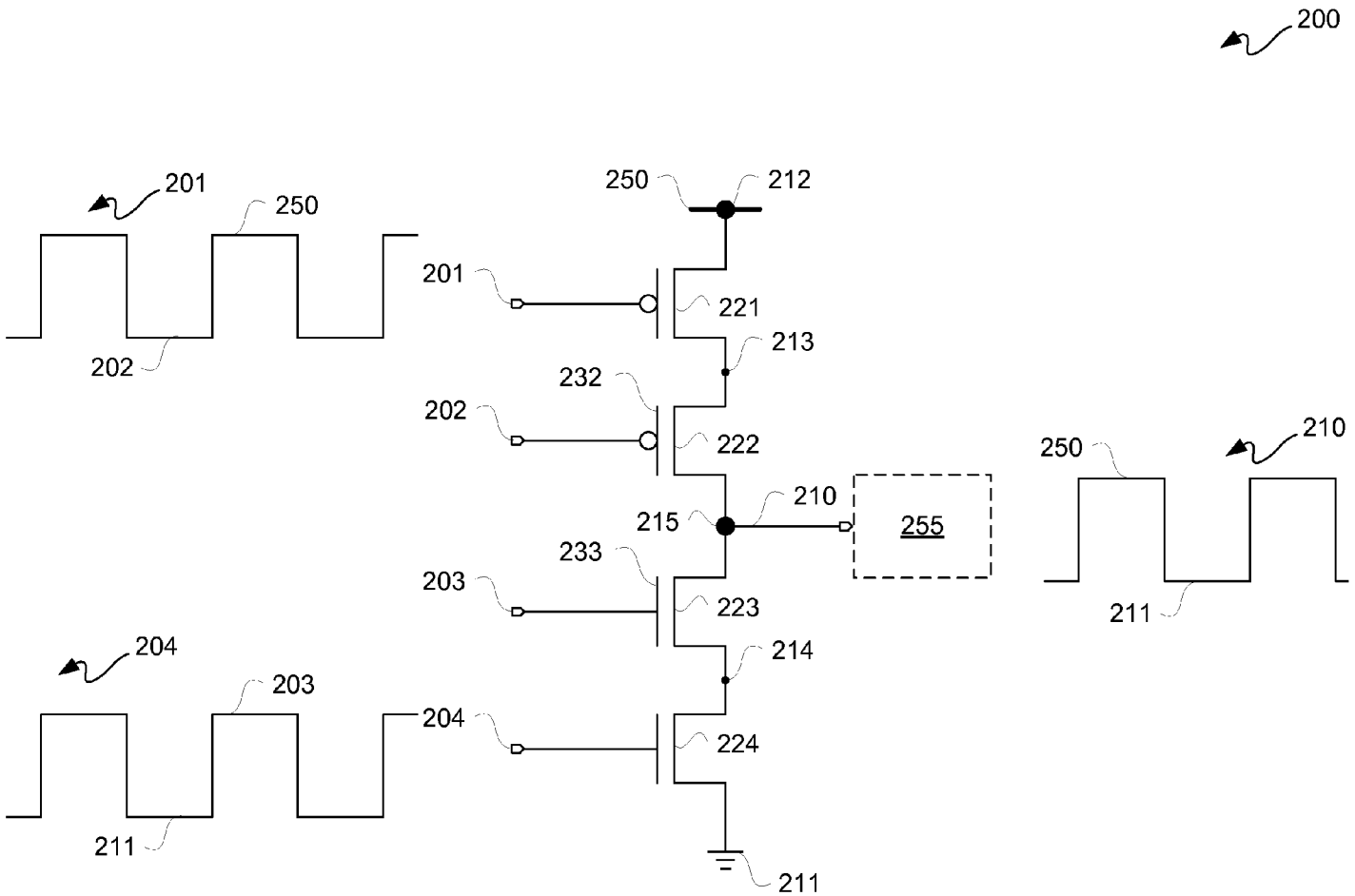
FIG. 2 is a circuit diagram depicting an exemplary embodiment of an output driver.

FIG. 2 is a circuit diagram depicting an exemplary embodiment of an output driver 200. Output driver 200 includes pull-up PMOS transistors 221 and 222 and pull-down NMOS transistors 223 and 224.

A source node of PMOS transistor 221 is coupled to a supply voltage node 212. Supply voltage node 212 may be for a VCC supply voltage or other high voltage level 250 from a power supply for example. For purposes of clarity by way of example and not limitation, it shall be assumed that supply voltage node 212 is at 3.3 volts for a high voltage level 250 from a power supply during operation; however, in other embodiments, higher or lower supply voltages may be used for an operational high voltage level in accordance with the following description.

A gate node of PMOS transistor 221 is coupled to receive an input signal 201; however, for purposes of clarity and not limitation, input signal 201 may be described below in additional detail as a bias voltage 201, because effectively input signal 201 during ramping up and down of power is a bias voltage. Similarly, input signal 204 may be described as a bias voltage 204. When in an operational mode, input signals 201 and 204 may be used. A drain node of PMOS transistor 221 is coupled to a source node of PMOS transistor 222, and this common node of PMOS transistors 221 and 222 is generally indicated as common pull-up node 213.

A gate node of PMOS transistor 222 is coupled to receive a bias voltage 202. A drain node of PMOS transistor 222 is coupled to output node 215 for sourcing an output signal 210. Output signal 210 is provided responsive to input signals 201 and 204.

A source node of NMOS transistor 224 is coupled to a ground voltage node 211. Ground voltage node 211 may be for a logic low voltage level, which is assumed to be a ground voltage of zero volts for purposes of clarity by way of example and not limitation. However, in other embodiments, higher or lower logic low voltages may be used in accordance with the following description.

A gate node of NMOS transistor 224 is coupled to receive a bias voltage 204. A drain node of NMOS transistor 224 is coupled to a source node of NMOS transistor 223, and this common node of NMOS transistors 223 and 224 is generally indicated as common pull-down node 214.

A gate node of NMOS transistor 223 is coupled to receive a bias voltage 203. A drain node of NMOS transistor 223 is coupled to output node 215 for sourcing an output signal 210.

For purposes of clarity by way of example and not limitation, it shall be assumed that each of transistors 221 through 224 is a 1.8 volt transistor. In other words, transistors 221 through 224 are designed to reliably operate for over a targeted lifetime provided such transistors do not experience voltages in excess of 1.8 volts.

As previously described, decoupling capacitance and/or circuit load, as generally indicated in phantom by block 255, may affect ramp up and ramp down rates of power supplies used to provide voltages 202, 203, and 250 to output driver 200. For purposes of clarity and not limitation, voltage 250 may alternatively be referred to as power supply 250, and likewise voltage 203 may alternatively be referred to as power supply 203. Such capacitance and/or circuit load 255 may be outside of the control of a manufacturer of an IC in which output driver 200 is located. For example, for a power down sequence, if capacitive load of transistor gates 232 and 233 respectively of transistors 222 and 223 is sufficiently lower than capacitive load of power supply 250, then gate voltages on transistors 222 and 223 may discharged faster than source voltage on transistor 222. Furthermore, high voltage level 250 at supply voltage node 212 may still be at a voltage level greater than 1.8 volts. This may result in transistors 221 and 222 being in a substantially conductive state with insufficient voltage on a gate of transistor 222 and with insufficient voltage on a gate of transistor 223 to prevent one or more overstress conditions. Thus, a voltage level greater than 1.8 volts may be conducted through transistors 221 and 222 to output node 215. So an overstress condition may arise on each of transistors 221, 222, and 223. This is just one example of many in which overstress conditions may arise. Along those lines, gate voltages on transistors 222 and 223 do not have to discharge to zero volts in order to have an overstress condition result; rather, one or more overstress conditions may result if a gate-to-source voltage and/or a gate-to-drain voltage is in excess of a maximum level of a transistor. Furthermore, an overstress condition may result during power up or power down; however, as described below in additional detail such overstress condition may be avoided during power up and power down without power sequencing.

As described below in additional detail, a bias voltage may be controlled to avoid an overstress condition. As will be appreciated from the following description, power up and/or power down sequencing of an IC may be avoided with respect to an output driver or other device of an IC die coupled to an external capacitive and/or circuit load. Along those lines, such control is provided without having to use one or more sequential voltage regulators for power up and/or power down sequencing.

However, before going into powering up or down, an understanding of operation may be helpful. During operation, bias voltage 201 may be held at a level to maintain transistor 221 in a conductive or substantially conductive ("ON") state. Likewise, during operation bias voltage 204 may be held at a level to maintain transistor 224 in an ON state. It should generally be understood that a PMOS or an NMOS transistor is in a non-conductive or substantially non-conductive ("OFF") state when gate-to-source voltage is too small.

Bias voltage 202 gating transistor 222 may be controlled to be high voltage level 250 of supply voltage node 212 minus an overstress condition voltage level, which in this example is 1.8 volts. In other words, bias voltage 202 may be controlled to be a high voltage 250 level of supply voltage node minus 1.8 volts, where such high voltage level provided by power supply 250 may ramp up or down independently with respect to one or more other power supplies during powering up or down, respectively, of an IC chip.

Bias voltage 203 is at a low voltage level supply voltage as described below in additional detail. Bias voltage 203 may be generated from an auxiliary power supply 203 as a safe voltage with respect to transistors. Along those lines, it shall be assumed for purposes of clarity by way of example and not limitation that bias voltage during operation is approximately 1.8 volts. However, again it should be understood that such low voltage level power supply 203 voltage may ramp up or down during powering up or down, respectively, of an IC chip.

During operation, transistor 221 is toggled ON and transistor 224 is toggled OFF to output a logic high state of approximately 3.3 volts, and transistor 221 is toggled OFF and transistor 224 is toggled ON to output a logic low stage of approximately 0 volts. Thus, during operation, supply voltage node 212 is coupled to output node 215 to output a logic 1, and ground 211 is coupled to output node 215 to output a logic 0. Generally, bias signal 201 is toggled to and from high voltage level 250 of 3.3 volts and a voltage level of bias voltage 202 of 1.5 volts, and bias signal 204 is toggled to and from a low voltage level of 1.8 volts and a ground 211 voltage level of 0 volts. This produces an output signal 210 which may be toggled between approximately a high voltage level 250 and a ground 211 voltage level.

Continuing the above example, during operation, voltage at common pull-up node 213 is at approximately 3.3 volts, and gate-to-source voltage of transistor 222 is a high voltage level of a power supply 250 or supply node 250 minus bias voltage 202, or 1.8 volts. In other words, the highest gate-to-source voltage that may be experienced by transistor 222 is 1.8 volts in this example.

To avoid overstressing during a power up or down sequence, bias voltages may be controlled during such power down sequence, as described below in additional detail.

Figure 3:
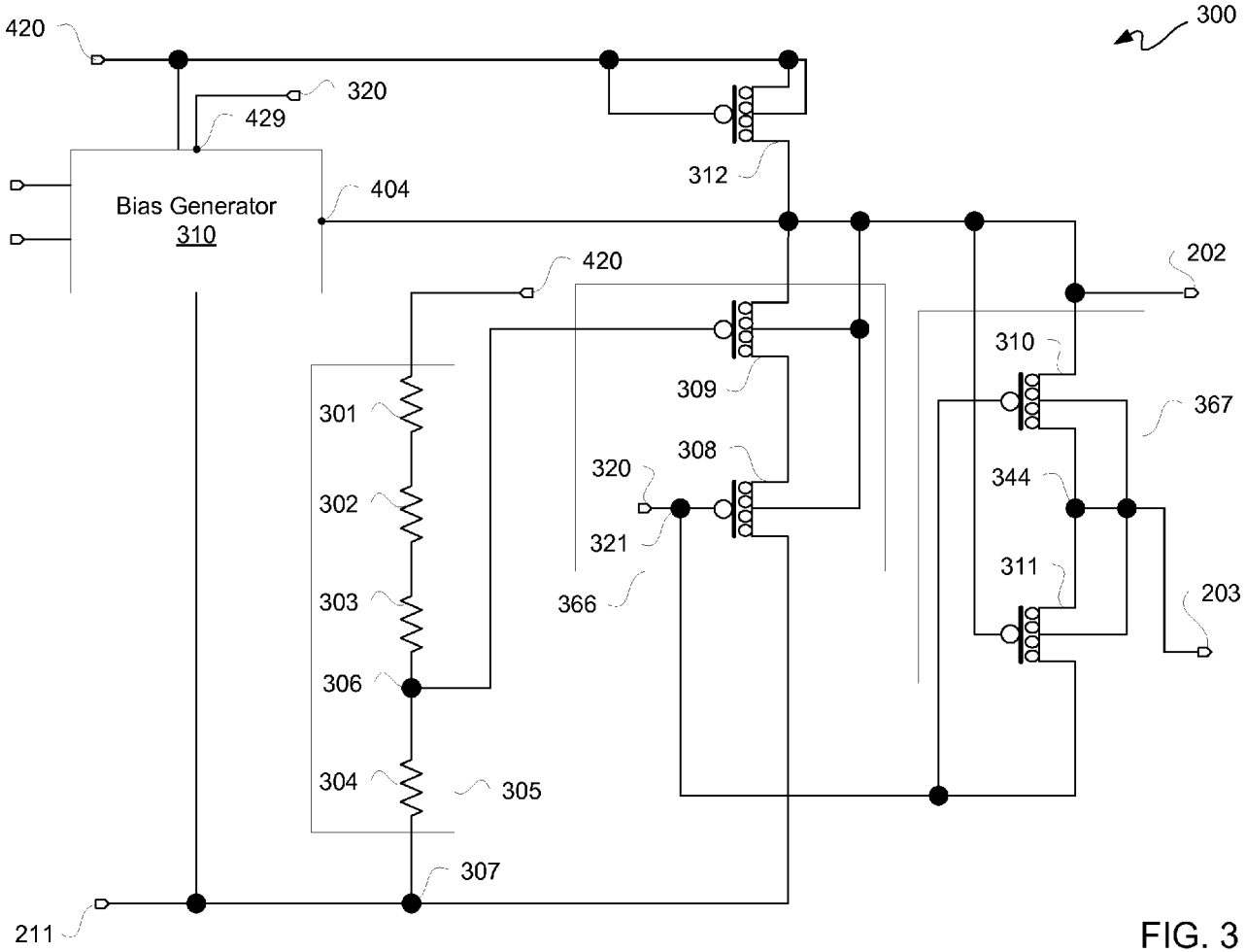
FIG. 3 is a block/circuit diagram depicting an exemplary embodiment of a bias voltage controller.

FIG. 3 is a block/circuit diagram depicting an exemplary embodiment of a bias voltage controller 300. Bias voltage controller 300 includes bias generator 310.

Figure 4:
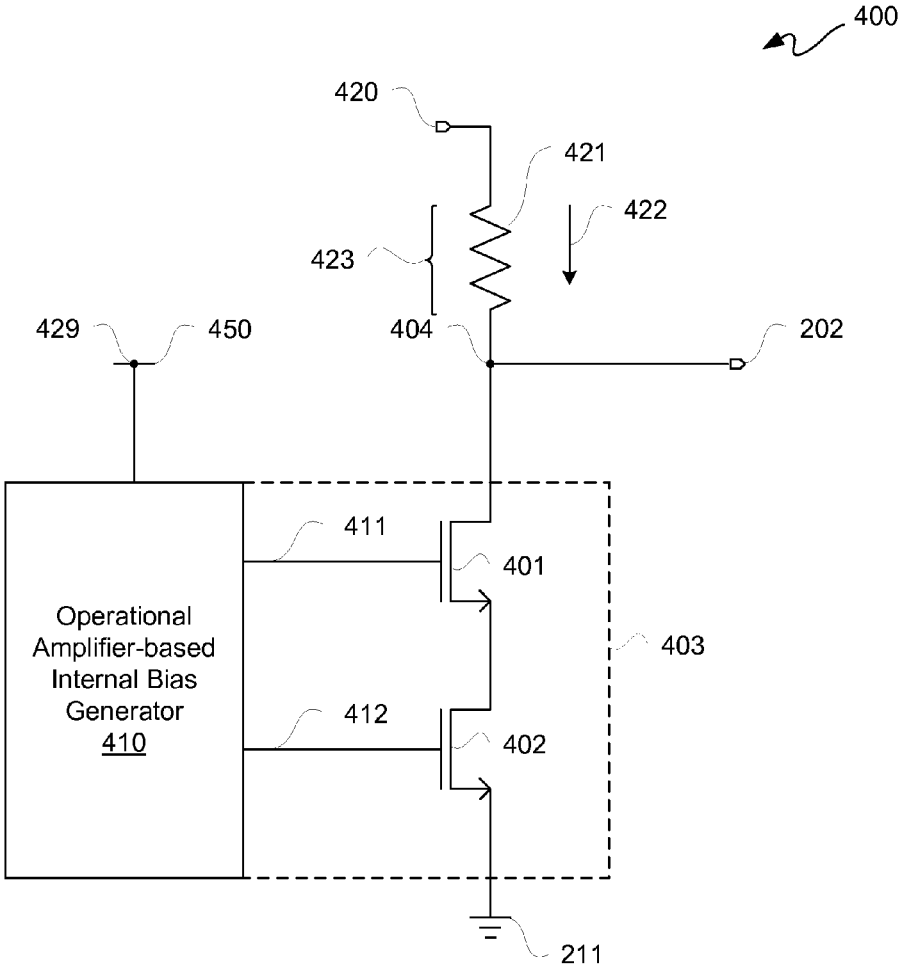
FIG. 4 is a block/circuit diagram depicting an exemplary embodiment of a bias generator.

FIG. 4 is a block/circuit diagram depicting an exemplary embodiment of a bias generator 400. Bias generator 400 may be used for bias generator 310 of FIG. 3. Bias generator 400 includes an operational amplifier-based internal bias generator ("OP amp generator") 410. NMOS transistors 401 and 402 may be an output stage of OP amp generator 410, as generally indicated by dashed line 403. Output from OP amp generator 410 are bias voltages 411 and 412. Bias voltage 411 gates transistor 401, and bias voltage 412 gates transistor 402. A source node of transistor 402 is coupled to ground 211, and a drain node of transistor 402 is coupled to a source node of transistor 401. A drain node of transistor 401 is coupled to a bias voltage source node 404, where bias voltage source node 404 may be used to provide bias voltage 202 of FIG. 2.

Supply voltage 420 may be coupled to supply voltage node 212 to provide a high voltage level 250 of FIG. 2. Along those lines supply voltage 420 may be power supply 250 of FIG. 2. For purposes of clarity by way of example and not limitation, it shall be assumed that supply voltage 420 is VCCO and is 3.3 volts. Supply voltage 420 is coupled to an end of a resistive load 421. Resistive load 421, even though depicted with a single discrete resistor, may be implemented with more than one resistor in parallel and/or series in other embodiments, to provide a fixed resistance. Another end of resistive load 421 is coupled to bias voltage source node 404.

OP amp generator 410 may be configured to hold a current 422 across resistive load 421 over ranges of process-voltage-temperature ("PVT") variations to produces a steady current-resistance ("IR") voltage drop 423 across resistive load 421. For purposes of clarity by way of example and not limitation, continuing the above example, IR voltage drop 423 is 1.8 volts, where for example resistive load 421 is 180 ohms, and where current 422 is maintained at approximately 100 micro amperes ("μa"). If temperature increases, current conducted across channels of transistors 401 and 402 may decrease, so bias voltages 411 and 412 may be increased so as to hold current 422 steady at approximately 100 μa. Thus, transistors 401 and 402 may be operated to different extends within a saturation region to increase or decrease channel size to correspondingly increase or decrease conductivity. In short, transistors 401 and 402 may be operated like variable resistors. However, transistors 401 and 402 are maintained in an ON state during operation. If, for example, either or both of transistors 401 and 402 were in an OFF state, namely bias voltage source node 404 was electrically decoupled from ground 211, then voltage at bias voltage source node 404 would be approximately 3.3 volts which would exceed the 1.8 volt limit of transistor 401 for example. Thus, by keeping both of transistors 401 and 402 at some conductivity level of an ON state, voltage at bias voltage source node 404 may be held at approximately 3.3 volts minus 1.8 volts.

OP amp generator 410 may be coupled to a supply voltage node 429 for generating bias voltages 411 and 412. Supply voltage node 429 may be used to provide a low voltage level 450 of a supply voltage 320 of FIG. 3. Supply voltage 320 of FIG. 3 may be an auxiliary supply voltage or other supply voltage for providing a logic high level, such as Vdd for example. A low voltage level 450 supply voltage, which may be Vdd for example, is a safe supply voltage level with respect to transistors. Along those lines, supply voltage 320 may be power supply 203 of FIG. 2.

Continuing the above example, for 1.8 volt transistors, a safe supply voltage level may be 1.8 volts. In other words, there are two supply voltages, namely a high voltage level and a low voltage level, where the high voltage level exceeds a maximum transistor voltage level for purposes of reliability and longevity, and where the low voltage level does not exceed a maximum transistor voltage level for purposes of reliability and longevity. To generate a bias voltage for protecting transistors from such high voltage level, a low voltage level supply voltage may be used. However, during power up and/or power down, such low voltage level supply may not have sufficient power to ensure no overstressing of transistors. To address this possibility, a high voltage level supply may be used, as described below in additional detail.

Operational amplifier-based internal bias generator 410 is configured to generate internal bias voltages 411 and 412 sufficient to electrically couple bias voltage source node 404 to ground node 211 via channels of NMOS transistors 401 and 402 responsive to voltage level 450 of low supply voltage 320 sufficient to maintain a current-resistive voltage drop 423 across resistive load 421 to protect output driver 200 from an overstress condition. However, if voltage level 450 is too low, such as for periods during powering up and down, for operational amplifier-based internal bias generator 410 to generate internal bias voltages 411 and 412 sufficient to electrically coupled bias voltage source node 404 to ground node 211 via channels of NMOS transistors 401 and 402, then responsive to voltage level 450 of low supply voltage 320 being too low for a current-resistive voltage drop 423 across resistive load 421 to protect output driver 200 from an overstress condition a high voltage supply 420 may be used to provide such voltage drop, as described below in additional detail.

With simultaneous reference to FIGS. 2, 3 and 4, high voltage level 250 supply voltage 420 is coupled to resistor ladder or resistor-divider network 305. In this exemplary embodiment, resistor-divider network 305 includes resistors 301 through 304 coupled in series; however, in other embodiments, fewer or more resistors may be used.

More particularly, resistors 301 through 303 are coupled in series between supply voltage 420 and a divided voltage output node 306 of resistor-divider network 305. Resistor 304 is coupled between divided voltage output node 306 and a ground node 307 coupled to ground 211.

Continuing the above example for example, suppose supply voltage 420 is approximately 3.3 volts, a resistor-divider of resistor-divider network 305 outputs on divided voltage output node 306 which is 3.3 volts divided by four, namely approximately a threshold voltage of PMOS transistor 309, which may be assumed to be 0.7 volts for purposes of clarity by way of example and not limitation. This voltage at divided voltage output node 306 may be another voltage provided it is a safe level for a bias voltage for a PMOS transistor 309. Thus, another fraction of a high voltage level may be used.

PMOS transistors 308 and 309, which may be coupled in source-drain series with one another, may be part of a "watch dog" circuit 366. "Watch dog" circuit 366 detectors watch when supply voltage 320 transitions below a threshold voltage or is below a threshold voltage, such as during a power down mode when voltage of supply voltage goes to zero volts or during a power up mode when voltage of supply voltage ramps up to Vdd. When voltage provided by supply voltage 320 is below such threshold voltage, such as below approximately node voltage 404 minus 0.7 volts in the above example, watch dog circuit 366 electrically couples itself to ground so as to sink current. When supply voltage 320 is sufficiently high, such as to put PMOS transistor 308 in an OFF state, then watch dog circuit 366 effectively turns itself off as it electrically decouples itself from ground 211.

A source/drain node of PMOS transistor 309 is coupled to bias voltage source node 404 and a gate of PMOS transistor 309 is coupled to divided voltage output node 306. PMOS transistors 308 through 312 of bias voltage controller 300 may be thick gate dielectric or gate oxide transistors for more reliability when operating at higher voltages. Another source/drain node of PMOS transistor 309 may be coupled to a source/drain node of PMOS transistor 308, and another source/drain node of PMOS transistor 308 may be coupled to ground node 307. A gate of PMOS transistor 308 may be coupled to a bias node 321, and such bias node 321 may be coupled to low voltage supply 320. PMOS transistors 308 and 309 may be back gate biased, also referred to as substrate biased or body biased, by coupling body regions thereof to bias voltage source node 404.

A gate of PMOS transistor 310 may be coupled bias node 321. A source/drain node of PMOS transistor 310 may be coupled to bias voltage source node 404, and another source/drain node of PMOS transistor 310 may be coupled to a source/drain node of PMOS transistor 311 at a bias voltage source node 344. Bias voltage source node 404 is a PMOS bias voltage source node for sourcing gate bias voltage 202, and bias voltage source node 344 is an NMOS vias voltage source node for sourcing gate bias voltage 203. Body regions of PMOS transistors 310 and 311 may be commonly coupled to bias voltage source node 344 for back gate biasing those transistors. A gate of PMOS transistor 311 may be coupled to bias voltage source node 404. In addition to a gate of PMOS transistor 310 being coupled to bias node 321, the other source/drain node of PMOS transistor may be coupled to bias node 321

Optionally, a PMOS transistor 312 may have a gate and a source node coupled to high voltage supply 420, and PMOS transistor 312 may have a drain node coupled to bias voltage source node 404. Moreover, such source node of PMOS transistor 312 may be coupled to a body region thereof for back gate biasing. PMOS transistor 312 may thus be coupled in a diode configuration to provide a charge leaker. Even when PMOS transistors 309 and 308 are OFF they may leak charge, such as to ground 211 for example. To balance this charge leakage, PMOS transistor 312 may be used, so such charge leakage does not negatively impact performance of bias generator 310 to move voltage higher or lower on bias voltage source node 404.

Assuming, a low voltage supply 320 is powered off or at least sufficiently low, such as during a power up or down, as to cause at least one of NMOS transistors 401 and 402 to be OFF, then, absent more, bias voltage source node 404 might be pulled up to an overstressing voltage level by supply voltage 420. However, supply voltage 420, via resistor-divider network 305, may be used as a bias voltage for PMOS transistor 309 to cause PMOS transistor 309 to turn ON with a safe bias voltage sourced from divided voltage output node 306.

Again, voltage on bias voltage source node 404 is not to be drawn down to zero volts by electrically coupling it to ground 211 through PMOS transistors 309 and 308. Furthermore, using PMOS transistors 308 and 309 as pull-down transistors, where PMOS transistor 309 is effectively used as a variable resistor which varies with strength of high voltage supply 420 voltage, and where PMOS transistor 308 is effectively used as a variable resistor which varies with strength of low voltage supply 320, a protective voltage level may be maintained on bias voltage source node 404 during power up and power down. Moreover, a PMOS transistor in a pull down function, in contrast to an NMOS transistor, is less likely to pull down all the way to zero volts, namely a PMOS transistor has less pull down strength than an NMOS transistor.

Accordingly, bias voltage source node 404 may be at a high voltage level 450 minus 1.8 volts, which high voltage level 450 may vary during power up and power down. For example, to have voltage on bias voltage source node 404 generally be between 1.8 and 1.2 volts, PMOS transistor 309 may be biased such that it stops discharging charge on bias voltage source node 404 when it reaches its current gate voltage plus approximately a threshold voltage of such transistor PMOS transistor 309. This prevents PMOS transistor 309 from pulling voltage on bias voltage source node 404 too low, namely pulling too close to ground or zero volts, and prevents voltage on bias voltage source node 404 from going too close to VCC, or more generally a high voltage level 450. In brief, during power up and power down, bias voltage 202 may be sourced such that there is sufficient voltage on a gate of PMOS transistor 222 to prevent an overstress condition, as previously described.

For low voltage supply 320 off or at least substantially low in voltage, PMOS transistors 308 and 310 turn ON. Thus, bias voltage source node 404 is coupled to ground 211 through PMOS transistors 309 and 308. Thus, effectively PMOS transistors 309 and 308 with voltage from high voltage supply 420 functionally replaces NMOS transistors 401 and 402 when low voltage supply 320 has a sufficiently low voltage. Along those lines, if voltage supply 320 has a sufficiently high voltage for bias, as previously described, then PMOS transistor 308, as well as PMOS transistor 310, are OFF. When PMOS transistor 308 is OFF, then neither of PMOS transistors 308 or 309 is used, as they are electrically decoupled from ground 211.

Again, assuming that low voltage supply 320 is off or substantially off such as during powering up or down, then there is a safe bias voltage 202 on bias voltage source node 404, as previously described. However, as low voltage supply 320 is off or substantially off, then, absent anything to the contrary, NMOS transistor 223 might be gated with zero volts or otherwise too low of a voltage to protect it from a high voltage level 250 coupled to output node 215 during power down. In other words, during power up and down, input signal 201 and bias voltage 202 may both be sufficiently low to turn both of those transistors ON, which would couple high voltage level 250 at supply voltage node 212 to output node 215. During power up and down, high voltage level 250 may be in excess of 1.8 volts when low voltage supply 320 is off or substantially off; however, there is a transition as between when to use either low voltage supply 320 or high voltage supply 420 to provide bias voltages 202 and 203. This transition was described for bias voltage 202, and now shall be described for bias voltage 203.

In order to detect when bias voltage 202 or a low voltage level 450 of low supply voltage 320 is higher, PMOS transistors 310 and 311 may be used. PMOS transistors 310 and 311 may be part of comparison circuit 367, which is configured to determine which of bias nodes 321 and 404 is at a higher voltage level. Bias voltage source node 344 is coupled to be the higher of bias voltage 202 and a low voltage level 450 of low supply voltage 320, as described below in additional detail.

If bias voltage 202 is sufficiently higher than supply voltage 320, then PMOS transistor 310 will turn ON and PMOS transistor 311 will turn OFF. With PMOS transistor 310 ON and PMOS transistor 311 OFF, bias voltage source node 344 is electrically coupled to bias voltage source node 404 via PMOS transistor 310. If, however, bias voltage 202 is sufficiently lower than supply voltage 320, then PMOS transistor 310 will turn OFF and PMOS transistor 311 will turn ON. With PMOS transistor 310 OFF and PMOS transistor 311 ON, bias voltage source node 344 is electrically coupled to bias node 321 via PMOS transistor 311 to receive supply voltage 320.

Accordingly, by providing a higher of bias voltage 202 and supply voltage 320 as bias voltage 203, NMOS transistor 223 may be protected from an overstress condition during power up, power down, and normal operation. Along those lines, for example, if supply voltage 320 is zero volts and bias voltage 202 is higher than zero volts, then such zero voltage condition is not passed to gate NMOS transistors 223 and 224. If such a condition were allowed to occur, then NMOS transistors 223 would have a zero on its gate potentially when a voltage in excess of 1.8 volts from VCC is coupled to output node 215, which would be a gate-to-drain violation, namely an overstressed condition. However, by having for example bias voltage 202, which is a safe voltage level, namely one that does not create an overstress condition and prevents an overstress condition, on a gate of NMOS transistor 223, then NMOS transistor 223 is protected from coupling VCC to output node 215 during power down and power up. In this example, such safe voltage level is a maximum of 1.5 volts; however, in other embodiments other safe voltage levels may be used. Moreover, for an NMOS transistor, voltage may be increased above 1.5 volts as such high voltage level increases turn ON strength. However, such safe voltage is not used for operation, as it would be a performance limiter, and thus during operation a 1.8 volt voltage level from supply voltage 320 is used.

Generally, by controlling bias voltages, switching between high and low supply voltages, and switching between bias voltage sources, provided for power up While the foregoing describes exemplary embodiments, other and further embodiments in accordance with the one or more aspects may be devised without departing from the scope thereof, which is determined by the claims that follow and equivalents thereof. Claims listing steps do not imply any order of the steps. Trademarks are the property of their respective owners.

What is claimed is:

1. An apparatus, comprising:

an output driver; and a bias voltage controller coupled to provide a first bias voltage and a second bias voltage to the output driver;

wherein the bias voltage controller comprises:

a bias generator coupled to a first voltage supply, a second voltage supply, and a ground node;

wherein the bias generator has a first bias node for sourcing the first bias voltage;

wherein the first voltage supply is configured to provide a higher voltage level than the second voltage supply;

a resistor-divider network coupled to the first voltage supply and the ground node;

a watch dog circuit coupled to the resistor-divider network, bias generator, and the ground node; and a comparison circuit coupled to the bias generator and the second voltage supply;

wherein the comparison circuit has a second bias node for sourcing the second bias voltage;

wherein the watch dog circuit is configured to detect when the second voltage supply is below a voltage level to electrically couple the first bias node to the ground node; and wherein the watch dog circuit is configured to detect when the second voltage supply is above the voltage level to electrically decouple the first bias node from the ground node.

2. The apparatus according to claim 1, wherein the watch dog circuit comprises:

a first PMOS transistor having a first gate, a first source/drain node, and a second source/drain node; and a second PMOS transistor having a second gate, a third source/drain node, and a fourth source/drain node.

3. The apparatus according to claim 2, wherein the resistor-divider network comprises:

a voltage output node located between a first resistive load and a second resistive load coupled in series between the first voltage supply and the ground node;

the first gate is coupled to the voltage output node;

the second gate is coupled to the second voltage supply;

the first source/drain node is coupled to the first bias node;

the second source/drain node and the third source/drain node are coupled to one another; and the fourth source/drain node is coupled to the ground node.

4. The apparatus according to claim 3, further comprising:

a third PMOS transistor having a third gate, a fifth source/drain node, and a sixth source/drain node;

wherein the third gate and the fifth source/drain node are commonly coupled to the first voltage supply; and wherein the sixth source/drain node is coupled to the first bias node.

5. The apparatus according to claim 1, wherein the comparison circuit is configured to couple a higher one of the first bias voltage and the second supply voltage to the second bias node to source the second bias voltage.

6. The apparatus according to claim 5, wherein the comparison circuit is coupled to the first bias node of the bias generator and the second voltage supply.

7. The apparatus according to claim 6, wherein the comparison circuit comprises:

a first PMOS transistor having a first gate, a first source/drain node, and a second source/drain node; and a second PMOS transistor having a second gate, a third source/drain node, and a fourth source/drain node.

8. The apparatus according to claim 7, wherein:

the first gate and the fourth source/drain node are commonly coupled to the second voltage supply;

the second source/drain node and the third source/drain node are coupled to one another at the second bias node; and the second gate and the first source/drain node are commonly coupled to the first bias node.

9. The apparatus according to claim 1, wherein the bias generator comprises:

a resistive load coupled between the first bias node and the first voltage supply; and an operational amplifier-based internal bias generator coupled to the ground node, the second supply voltage, and the first bias node.

10. The apparatus according to claim 9, wherein:

the operational amplifier-based internal bias generator comprises:

a first NMOS transistor having a first gate, a first source/drain node, and a second source/drain node; and a second NMOS transistor having a second gate, a third source/drain node, and a fourth source/drain node; and the resistive load is at least one discrete resistor.

11. The apparatus according to claim 10, wherein:

the operational amplifier-based internal bias generator is configured to generate a first internal bias and a second internal bias;

the first internal bias is coupled to the first gate;

the second internal bias is coupled to the second gate;

the first source/drain node is coupled to the first bias node;

the second source/drain node and the third source/drain node are coupled to one another; and the fourth source/drain node is coupled to the ground node.

12. The apparatus according to claim 11, wherein the operational amplifier-based internal bias generator is configured to generate the first internal bias and the second internal bias sufficient to electrically coupled the first bias node to the ground node via the first NMOS transistor and the second NMOS transistor responsive to voltage level of the second supply voltage sufficient to maintain a current-resistive voltage drop across the resistive load to protect the output driver from an overstress condition.

13. The apparatus according to claim 1, wherein the output driver comprises:

a first PMOS transistor having a first gate, a first source node, and a first drain node;

a second PMOS transistor having a second gate, a second source node, and a second drain node;

a first NMOS transistor having a third gate, a third source node, and a third drain node; and a second NMOS transistor having a fourth gate, a fourth source node, and a fourth drain node.

14. The apparatus according to claim 13, wherein:

the first gate is coupled to receive a first signal for output via an output node of the output driver;

the fourth gate is coupled to receive a second signal for output via the output node;

the second gate is coupled to the first bias node to receive the first bias voltage; and the third gate is coupled to the second bias node to receive the second bias voltage.

15. The apparatus according to claim 14, wherein the bias voltage controller is configured to control the first bias voltage to be a voltage level of the first supply voltage minus a predetermined voltage sufficient to prevent an overstress condition.

16. The apparatus according to claim 14, wherein the bias voltage controller is configured to provide the second bias voltage a higher one of the second supply voltage and the first bias voltage.

* * * * *